US007848667B2

(12) United States Patent
Ishi

(10) Patent No.: US 7,848,667 B2
(45) Date of Patent: Dec. 7, 2010

(54) WASTE TONER COLLECTION APPARATUS AND IMAGE FORMING APPARATUS

(75) Inventor: Jun Ishi, Izunokuni (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 889 days.

(21) Appl. No.: 11/676,567

(22) Filed: Feb. 20, 2007

(65) Prior Publication Data

US 2007/0196117 A1 Aug. 23, 2007

(30) Foreign Application Priority Data

Feb. 20, 2006 (JP) ..... 2006-042775

(51) Int. Cl.
*G03G 21/12* (2006.01)
*G03G 15/08* (2006.01)
*G03G 21/00* (2006.01)

(52) U.S. Cl. ..... 399/35; 399/120; 399/257; 399/358

(58) Field of Classification Search ..... 399/35, 399/120, 257, 358, 360
See application file for complete search history.

(56) References Cited

U.S. PATENT DOCUMENTS

2005/0036810 A1* 2/2005 Murakami et al. ..... 399/360

FOREIGN PATENT DOCUMENTS

JP 2002-148884 5/2002

* cited by examiner

*Primary Examiner*—David M Gray
*Assistant Examiner*—Joseph S Wong
(74) *Attorney, Agent, or Firm*—Turocy & Watson, LLP

(57) ABSTRACT

The waste toner flown into a waste toner box by way of a plurality of collection ports is leveled by means of a paddle. The waste toner collected in the waste toner box is supplied to a full condition sensing section arranged at a higher position so as to be piled up by means of an auxiliary paddle 42. A photodetector detects the waste toner that is accumulated higher at the position of the full condition sensing section than at the other area of the waste toner box to detect a full condition of the waste toner box.

16 Claims, 7 Drawing Sheets

WASTE TONER COLLECTION APPARATUS AND IMAGE FORMING APPARATUS

CROSS REFERENCE TO RELATED APPLICATION

This application is based upon and claims the benefit of priority from prior Japanese Patent Application No. 2006-42775 filed on Feb. 20, 2006, the entire contents of which are incorporated herein by reference.

BACKGROUND OF THE INVENTION

1. Field of the Invention

This invention relates to a waste toner collection apparatus for collecting waste toner used in an electro-photography type copying machine, a printer or the like adapted to produce a color image by laying toner images of a plurality of different colors one on the other, and an image forming apparatus adapted to be used with such a waste toner collection apparatus.

2. Description of the Background

A cleaning apparatus such as a blade is normally operated to remove the toner remaining on a photosensitive member of an image forming apparatus such as a copying machine or a printer after the end of an image transfer process. The toner removed from the photosensitive member is collected in a waste toner box as waste toner. When the waste toner box becomes full, a sensor detects that the waste toner box is full and the latter is replaced by a new one.

Tandem type image forming apparatus have been marketed in recent years. A plurality of image forming units, each having a photosensitive member, are arranged in parallel in a tandem type image forming apparatus and the toner images of different colors formed on the respective photosensitive members are transferred onto a single sheet of paper and laid one on the other to produce a color image. Each of the photosensitive members occur residual toner in such a tandem type image forming apparatus. When toner images of different colors are transferred one on the other onto an intermediate transfer belt, the intermediate transfer belt also occur residual toner thereon. Apparatus for collecting the residual toners on a plurality of photosensitive members and a transfer medium in a single waste toner box are known. For example, Jpn. Pat. Publication (Kokai) No. 2002-148884 discloses such an apparatus.

The apparatus disclosed in the above-cited Publication is adapted to collapse the waste toner accumulated in the waste toner box and force it to come toward the center space when the waste toner comes above the capacity upper limits at the longitudinal opposite ends of the box main body. Then, as the waste toner that is collapsed and forced to come to the center space gets to the sensing position of a sensor, the sensor detects that the box is full. With the disclosed apparatus, however, waste toner can come above the capacity upper limits at the opposite ends if there is still a space at the center of the box and the sensor does not detect that the box is full. In such a condition, the box can no longer accept waste toner at the opposite ends thereof to consequently lock the waste toner conveyance mechanism at the opposite ends. Additionally, waste toner can spill out from the collection port of the closure member at the opposite ends of the box main body to contaminate the surroundings.

Therefore, there is a demand for waste toner collection apparatus to be used for a tandem type image forming apparatus having a plurality of image forming units arranged that can prevent a particular waste toner conveyance mechanism from being locked or waste toner from spilling out from a particular collection port and also prevent waste toner from being unevenly accumulated in the waste toner box while being able to highly accurately detect the full condition of the waste toner box when collecting the waste toner occurred from the image forming units and/or the transfer medium in a single waste toner box in order to use the waste toner box effectively and collect waste toner in safe. There is also a demand for image forming apparatus that can be used with such a waste toner collection apparatus.

SUMMARY OF THE INVENTION

An aspect of the present invention is to provide a tandem type image forming apparatus having a plurality of image forming units arranged, wherein the waste toner collected from a plurality of collection ports is leveled by a leveling member in a waste toner containing member and also supplied to a full condition sensing section by a waste toner supply member, so that the full condition sensor may detect the waste toner collected up to an upper position by a drive shaft of the leveling member and the quantity of waste toner collected in the waste toner containing member may be increased with a wide margin for the volume of waste toner that can be collected in the entire waste toner containing member. Thus, as aspect of the present invention is to prevent a particular waste toner conveyance mechanism from being locked because waste toner is accumulated unevenly before the waste toner containing member becomes full and also prevent waste toner from spilling out from a particular collection port to contaminate the surroundings so that waste toner may be collected safely and effectively.

According to an embodiment of the present invention, there is provided a waste toner collection apparatus including: a waste toner containing member extending in the direction of arrangement of a plurality of image forming units respectively having toner image forming means arranged around image carrier so as to contain the waste toner conveyed out from the plurality of image forming units; a plurality of collection ports arranged at the waste toner containing member to collect the waste toner; a leveling member for leveling the waste toner collected through the plurality of collection ports in the waste toner containing member; a full condition sensing section formed at an upper part of the waste toner containing member to introduce the waste toner driven to get to an upper position by the drive shaft of the leveling member; a waste toner supply member for supplying the waste toner to the full condition sensing section; and a full condition sensor for sensing the waste toner introduced to the full condition sensing section.

DETAILED DESCRIPTION OF THE INVENTION

Figure 1:
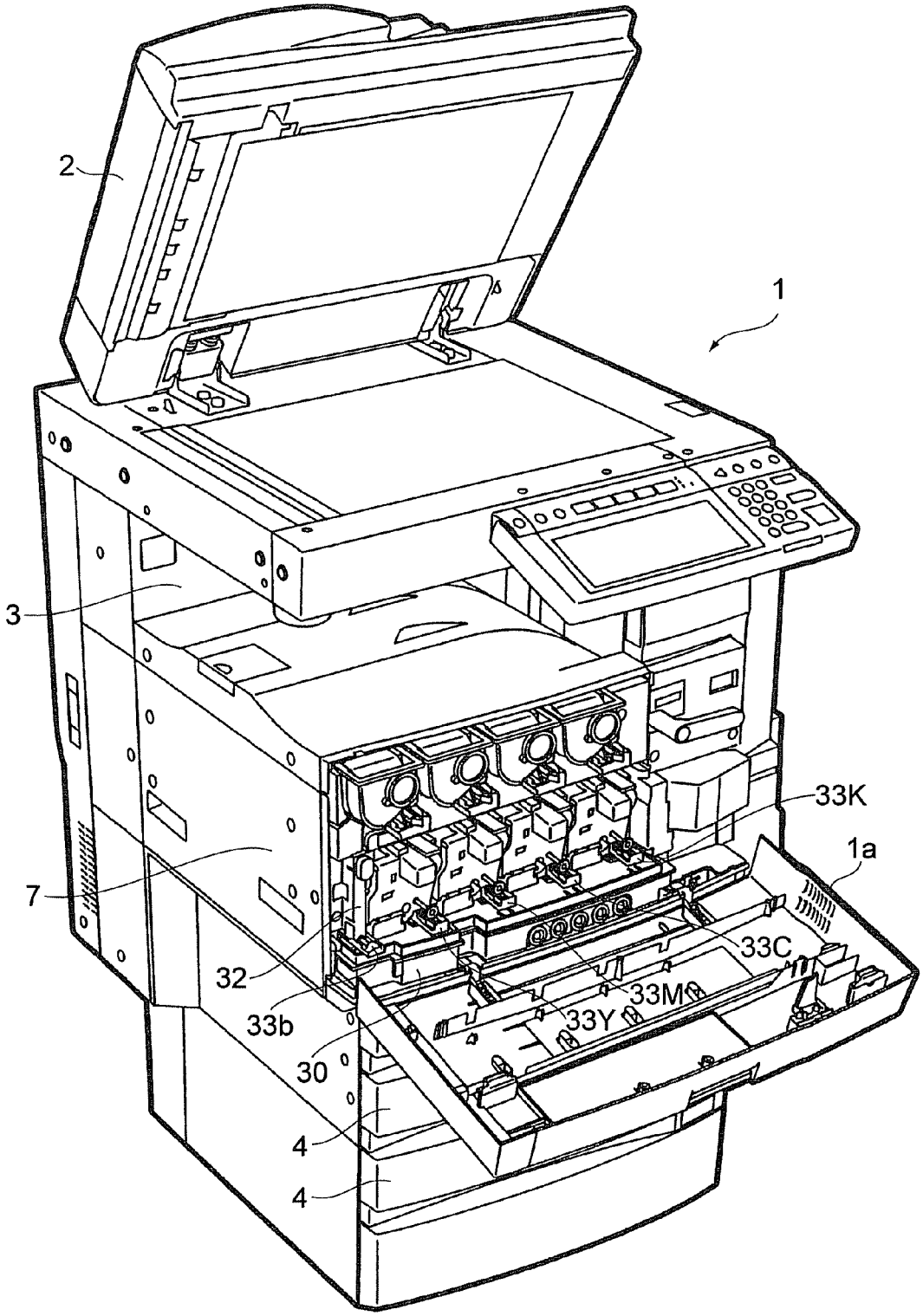
FIG. 1 is a schematic perspective view of an embodiment of the present invention which is a color copying machine, showing the appearance thereof when its front cover is opened.
Figure 2:
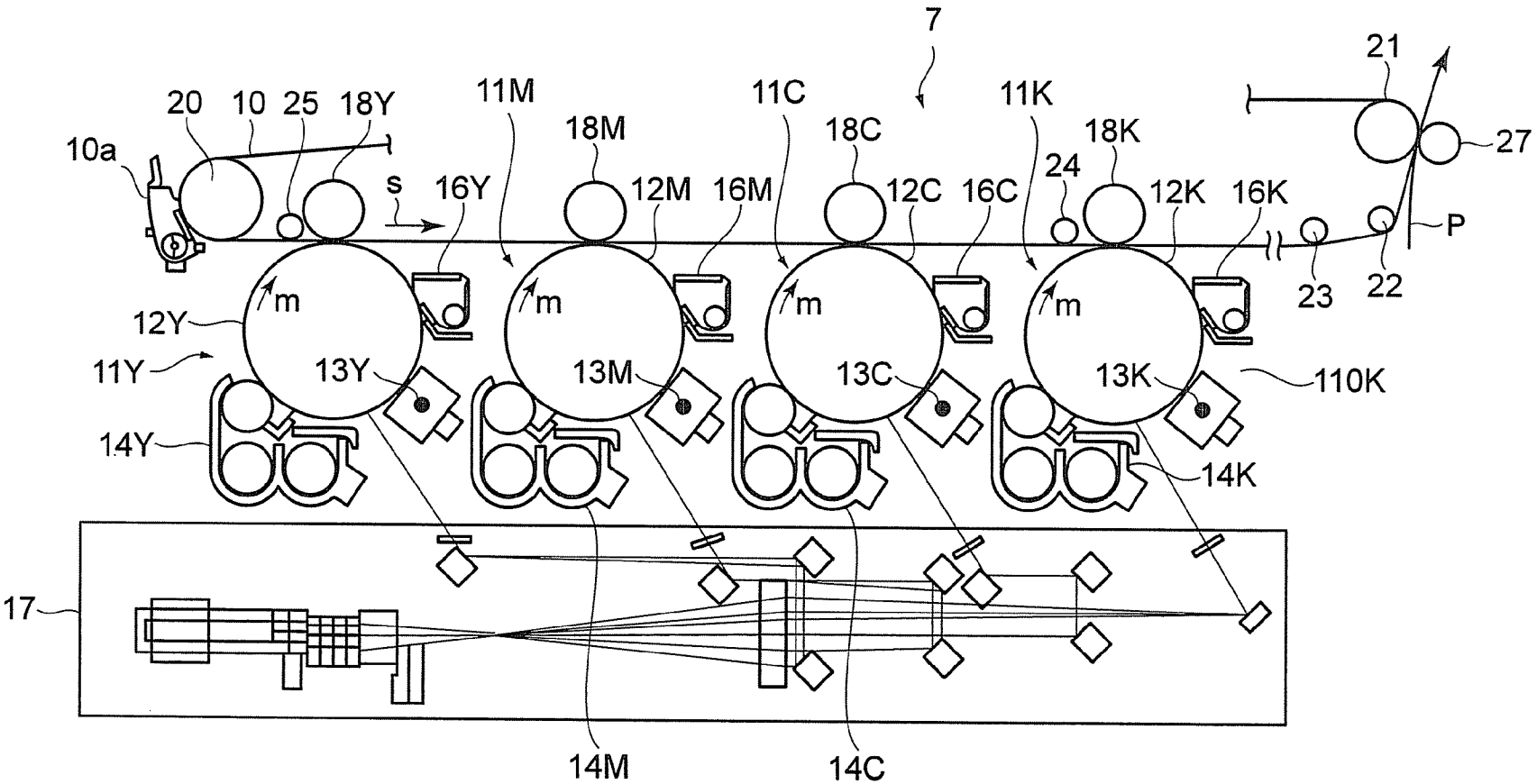
FIG. 2 is a schematic illustration of an image forming section according to the embodiment of the present invention.

Now, preferred embodiment of the present invention will be described in greater detail by referring to the accompanying drawings. FIG. 1 is a schematic perspective view of an embodiment of the present invention which is a 4-unit tandem type color copying machine 1, showing the appearance thereof when its front cover 1*a* is opened. FIG. 2 is a schematic illustration of an image forming section 7 of the color copying machine 1, showing the configuration thereof. The color copying machine 1 comprises a scanner section 2 and an inter-body sheet ejecting section 3 arranged in an upper part thereof. The color copying machine 1 further comprises four image forming units 11Y, 11M, 11C and 11K arranged in parallel below an intermediate transfer belt 10, which is a transfer medium, for yellow (Y), magenta (M), cyan (C) and black (K) images respectively.

The image forming units 11Y, 11M, 11C and 11K have respective photosensitive drums 12Y, 12M, 12C and 12K that are image carriers. Electric chargers 13Y, 13M, 13C and 13K, development apparatus 14Y, 14M, 14C and 14K and photosensitive member cleaning apparatus 16Y, 16M, 16C and 16K, which are cleaning members, are arranged respectively around the photosensitive drums 12Y, 12M, 12C and 12K in the mentioned order in the direction of rotation thereof as indicated by arrows m. Laser beams are irradiated respectively onto the surfaces of the photosensitive drums 12Y, 12M, 12C and 12K from a laser exposure apparatus 17 in the spans from the electric chargers 13Y, 13M, 13C and 13K to the development apparatus 14Y, 14M, 14C and 14K.

The electric charger 13Y, 13M, 13C and 13K uniformly charge the surfaces of the respective photosensitive drums 12Y, 12M, 12C and 12K with electricity to about −700V, for example. The development apparatus 14Y, 14M, 14C and 14K supply the photosensitive drums 12Y, 12M, 12C and 12K with 2-ingredient development agents containing respectively yellow (Y), magenta (M), cyan (C) and black (K) toners and carrier.

The laser exposure apparatus 17 scans the photosensitive drums 12Y, 12M, 12C and 12K in the respective axial directions by means of the laser beams emitted from a semiconductor laser element to from images on the photosensitive drums 12Y, 12M, 12C and 12K by way of a focusing lens system.

The intermediate transfer belt 10 is made of a stable material in terms of heat resistance and abrasion resistance, which may typically be a semiconductor polyimide. The intermediate transfer belt 10 is wound around a drive roller 21, a follower roller 20 and first through fourth tension rollers 22-25 and held at tension. A primary transfer voltage is applied to the intermediate transfer belt 10 at the primary transfer positions thereof where it faces the photosensitive drums 12Y, 12M, 12C and 12K by means of respective primary transfer rollers 18Y, 18M, 18C and 18K so that the toner images on the photosensitive drums 12Y, 12M, 12C and 12K are transferred onto the intermediate transfer belt 10 in a primary transfer operation. After the completion of the primary transfer operation, the photosensitive member cleaning apparatus 16Y, 16M, 16C and 16K respectively collect the residual toners on the photosensitive drums 12Y, 12M, 12C and 12K as waste toner.

A secondary transfer roller 27 is arranged vis-à-vis the intermediate transfer belt 10 at the secondary transfer position where it is supported by the drive roller 21. A secondary transfer voltage is applied at the secondary transfer position to the toner image on the intermediate transfer belt 10 by means of the secondary transfer roller 27 and by way of a sheet of paper P that is supplied from a sheet feeding section 4, for example. As a result, the toner image on the intermediate transfer belt 10 is transferred onto the sheet of paper P in a secondary transfer operation. A belt cleaner 10*a* is arranged at a downstream position of the intermediate transfer belt 10 relative to the secondary transfer roller 27. The belt cleaner 10*a* collects the toner remaining on the intermediate transfer belt 10 after the completion of the secondary transfer operation as waste toner.

A waste toner box 30, which is a waste toner containing member, is replaceable placed at a position in front of the image forming section 7 of the color copying machine 1, that is, below the image forming units 11Y, 11M, 11C and 11K and hence in front of the laser exposure apparatus 17. The waste toner box 30 is an elongate shape extending in the direction of arrangement of the image forming units 11Y, 11M, 11C and 11K. The waste toner box 30 is adapted to contain the waste toner collected from the photosensitive member cleaning apparatus 16Y, 16M, 16C and 16K of the image forming units 11Y, 11M, 11C and 11K and the belt cleaner 10*a*. When the waste toner box 30 becomes full, the full condition is detected and the waste toner box 30 is replaced by a new one.

Figure 3:
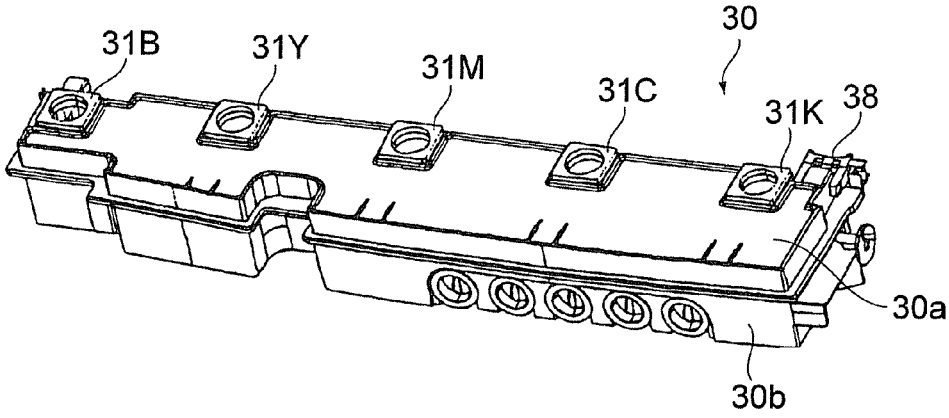
FIG. 3 is a schematic perspective view of a waste toner box according to the embodiment of the present invention.

Now, the waste toner box 30 will be described in greater detail below. As shown in FIG. 3, the closure section 30*a* of the waste toner box 30 is provided with first through fifth collection ports 31B, 31Y, 31M, 31C and 31K for collecting waste toner. The first collection port 31B collects the waste toner conveyed from the belt cleaner 10*a*. The second through fifth collection ports 31Y, 31M, 31C and 31K collect the waste toners conveyed respectively from the photosensitive member cleaning apparatus 16Y, 16M, 16C and 16K.

The waste toner conveyance mechanism 32 of the belt cleaner 10*a* and the waste toner conveyance mechanisms (not shown) of the photosensitive member cleaning apparatus 16Y, 16M. 16C and 16K are respectively provided at the connection terminals thereof to be connected with the waste toner box 30 with first through fifth shutters 33B, 33Y, 33M, 33C and 33K for opening and closing the first through fifth collection ports 31B, 31Y, 31M, 31C and 31K. The first through fifth shutters 33B, 33Y, 33M, 33C and 33K respectively open the first through fifth collection ports 31B, 31Y, 31M, 31C and 31K after mounting the waste toner box 30 in the color copying machine 1 and closing the front cover 1*a*.

Figure 4:
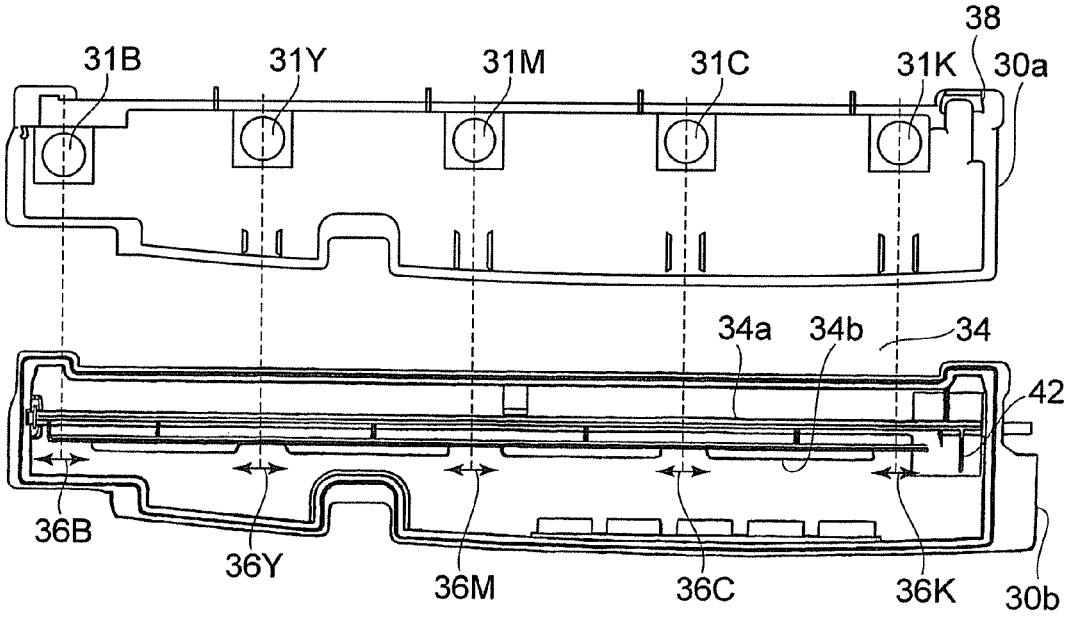
FIG. 4 is a schematic plan view of a closure section and a main body section of the waste toner box according to the embodiment of the present invention.
Figure 5:
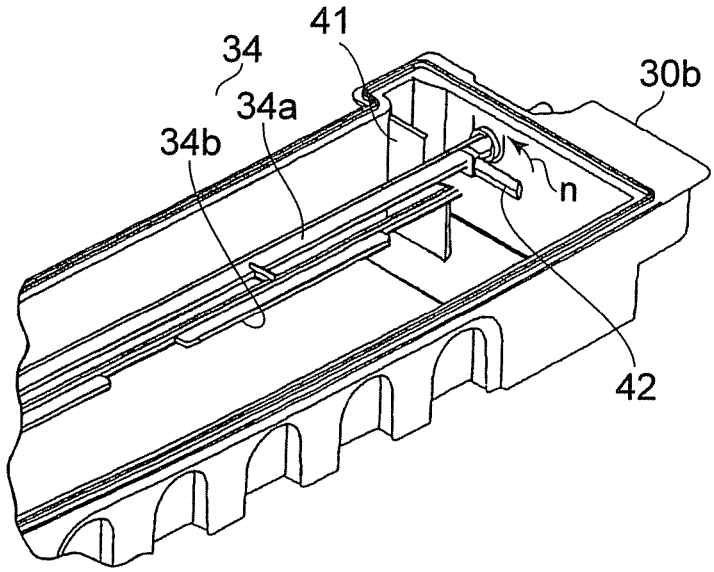
FIG. 5 is a schematic perspective view of part of the main body section of the waste toner box according to the embodiment of the present invention.

As shown in FIGS. 4 and 5, a paddle 34 is arranged in the inside of the main body section 30*b* of the waste toner box 30. The paddle 34 is a leveling member extending along the entire length of the longitudinal direction of the waste toner box 30. The paddle 34 includes a shaft 34*a* that is a drive shaft and fins 34*b* fitted to the shaft 34*a*. By driving the shaft 34*a* to rotate, the paddle 34 scatters the waste toner flown in from the first through fifth collection ports 31B, 31Y, 31M, 31C and 31K and accumulated to form a mound so as to level it in the longitudinal direction.

First through fifth cutting regions 36B, 36Y, 36M, 36C and 36K are formed in the regions of the fins 34*b* located respectively opposite to the first through fifth collection ports 31B, 31Y, 31M, 31C and 31K. The first through fifth cutting regions 36B, 36Y, 36M, 36C and 36K prevent waste toner be blown up toward the first fifth collection ports 31B, 31Y, 31M, 31C and 31K when the paddle 34 is driven to rotate.

Figure 6:
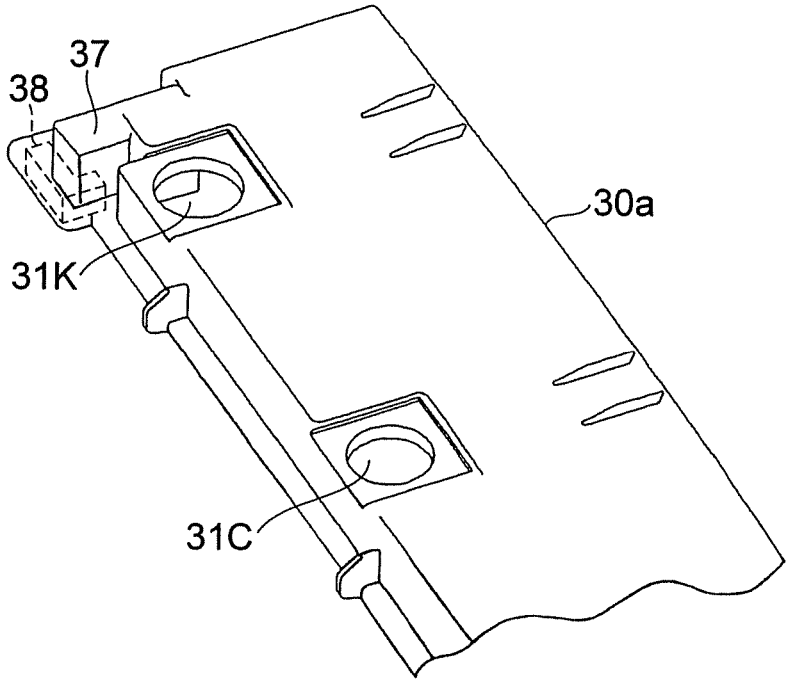
FIG. 6 is a schematic perspective view of part of the closure section of the waste toner box according to the embodiment of the present invention.

The closure member 30*a* is made of a transparent material and provided at the opposite ends thereof respectively with a full condition sensing section 37 for detecting the full condition of the waste toner box 30. The full condition sensing section 37 is projecting from an end of the closure member 30*a*. A transparent type photodetector 38 having a light emitting element 38*a* and a light receiving element 38*b* is fitted to the outside of the full condition sensing section 37. As shown in FIG. 6, the photodetector 38 as a full condition detector detects that waste toner gets to the inside of the full condition sensing section 37.

Figure 7:
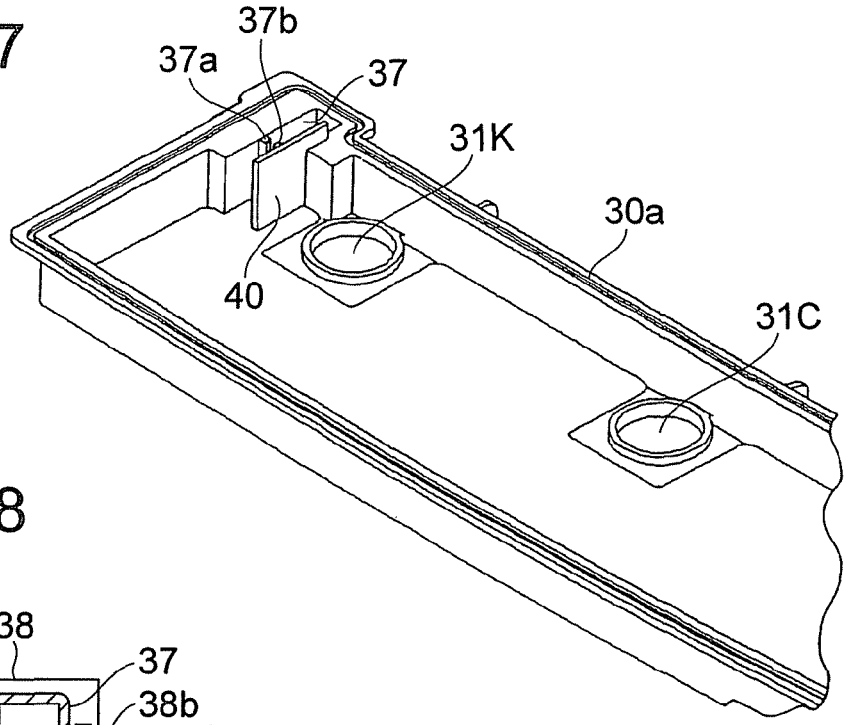
FIG. 7 is a schematic perspective view of part of the under surface of the closure section of the waste toner box according to the embodiment of the present invention.
Figure 8:
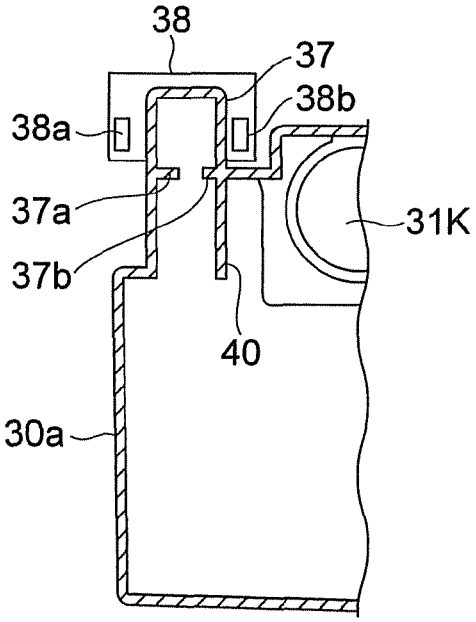
FIG. 8 is a schematic plan view of part of the under surface of the closure section of the waste toner box according to the embodiment of the present invention.

FIGS. 7 and 8 illustrate the inside of the full condition sensing section 37. The full condition sensing section 37 and the adjacent fifth collection port 31K are separated by a flat-plate-shaped wall 40 that is a partition member. The entrance of the full condition sensing section 37 that is defined by the wall 40 is provided with inwardly projecting lateral gates 37*a*, 37*b*. Thus, the entrance of the full condition sensing section 37 is made narrow by the lateral gates 37*a*, 37*b* to prevent floating toner from entering into the full condition sensing section 37.

A lower wall 41 is formed in the main body section 30*b* in a region located vis-à-vis the full condition sensing section 37 and aligned with the wall 40 of the closure member 30*a*. An auxiliary paddle 42 is arranged in a region defined by the lower wall 41. The auxiliary paddle 42 as a waste toner supplying member is a narrow and fin-shaped for supplying waste toner to the full condition sensing section 37 for the purpose of sensing a full condition. The auxiliary paddle 42 is fitted to the shaft 30*a* of the paddle 30 and, when it is driven to rotate, it moves through the lateral gates 37*a*, 37*b* arranged at the entrance of the full condition sensing section 37. The auxiliary paddle 42 is made to have a small thickness typically as small as 1.5 mm in order to minimize flying toner particles that can be produced when it is driven to rotate.

Now, the operation of the above-described embodiment will be described below. As an image forming process starts and image information is input from the scanner, a personal computer or the like, the photosensitive drums 12Y, 12M, 12C and 12K are driven to rotate and image forming steps are performed sequentially at the image forming units 11Y, 11M, 11C and 11K. The surface of the photosensitive drum 12Y is uniformly charged with electricity in the yellow (Y) image forming unit 11Y by the electric charger 13Y.

Subsequently, a laser beam that corresponds to the input yellow (Y) image information is irradiated onto the photosensitive drum 12Y at the exposure position 17Y to form an electrostatic latent image. Then, a toner image is formed on the photosensitive drum 12Y by the development apparatus 18Y. Thereafter, the photosensitive drum 12Y contacts the intermediate transfer belt 10 that is driven to rotate in the direction of arrow s in FIG. 2 so that the toner image is transferred onto the intermediate transfer belt 10 by means of the primary transfer roller 18Y in a primary transfer operation.

A toner image forming process similar to the above-described yellow (Y) toner image forming process is executed for each of the remaining colors including magenta (M), cyan (C) and black (K). The toner images formed on the photosensitive drums 12M, 12C and 12K are sequentially laid on the intermediate transfer belt 10 one on the other at the position where the yellow (Y) toner image is formed. Thus, a full color toner image is formed on the intermediate transfer belt 10 as a result of the multi-transfer operation for yellow (Y), magenta (M), cyan (C) and black (K).

Thereafter, the full color toner image formed on the intermediate transfer belt 10 by laying the monochromatic toner images gets to the position of the secondary transfer roller 27 and is transferred onto a sheet of paper P at a time due to the transfer bias voltage of the secondary transfer roller 27 in a secondary transfer operation. Then, the sheet of paper P is subjected to a fixing process to finish the toner image. If an image is to be formed only on one of the surfaces of the sheet of paper P, the sheet of paper P is discharged to the inter-body sheet ejecting section 3 after the fixing process. If an image is to be formed on both of the surfaces of the sheet of paper P, or a multiplex printing is to be performed, the sheet of paper P is brought back to the position of the secondary transfer roller 27 by means of a re-conveyance unit (not shown).

Meanwhile, after the secondary transfer operation, the intermediate transfer belt 10 is cleaned by the belt cleaner 10*a* to remove the residual toner. Similarly, after the toner images on the photosensitive drums 12Y, 12M, 12C and 12K are transferred onto the intermediate transfer belt 10 in the primary transfer operation, the photosensitive drums 12Y, 12M, 12C and 12K are cleaned respectively by the photosensitive drum cleaning apparatus 16Y, 16M, 16C and 16K to remove the residual toners to become ready for the next image forming process.

The waste toners that are the residual toners collected respectively by the belt cleaner 10*a* and the photosensitive member cleaning apparatus 16Y, 16M, 16C and 16K are then conveyed to the waste toner box 30 by means of the waste toner conveyance mechanism 32 of the belt cleaner 10*a* and the waste toner conveyance mechanisms (not shown) of the photosensitive member cleaning apparatus 16Y, 16M, 16C and 16K. The waste toners that are conveyed to the waste toner box 30 are then flown into the waste toner box 30 by way of the first through fifth collection ports 31B, 31Y, 31M, 31C and 31K respectively.

Figure 9:
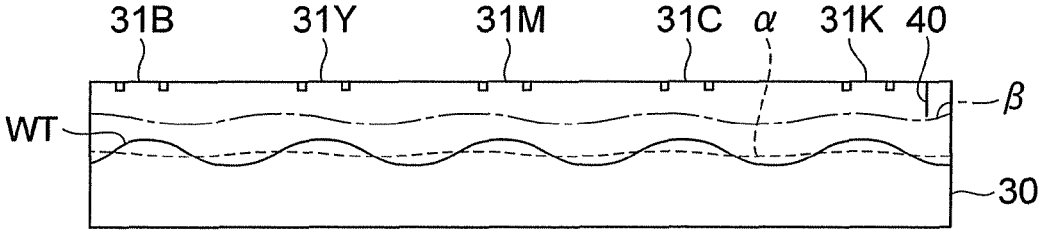
FIG. 9 is a schematic illustration showing how the waste toner is collected and accumulated in the waste toner box according to the embodiment of the present invention.

As a result, waste toner WT is accumulated below the first through fifth collection ports 31B, 31Y, 31M, 31C and 31K of the waste toner box 30 to form so many heaps as shown in FIG. 9. Note, however, as waste toner WT flows in, the paddle 34 is driven to rotate in the direction of arrow n e.g., at a high rate of 300 r.p.m. and scatter the waste toner by means of the fin 34*b* to level the waste toner WT in the waste toner box 30. Additionally, the auxiliary paddle 42 is driven at the same time along with the paddle 34 to supply waste toner WT to the full condition sensing section 37. Thus, the waste toner WT is leveled in the waste toner box 30 in the longitudinal direction as indicated by dotted line a in FIG. 9. Note, however, the auxiliary paddle 42 is driven to rotate at the full condition sensing section 37. Therefore, waste toner is supplied to the full condition sensing section 37 that is located above the waste toner box 30 and piled up there by means of the auxiliary paddle 42. Thus, the level of waste toner in the full condition sensing section 37 is slightly higher than that of waste toner in the waste toner box 30.

Floating toner is occurred in the waste toner box 30 as the paddle 34 is driven to rotate. However, floating toner is prevented from entering the full condition sensing section 37 because the entrance of the full condition sensing section 37 is narrowed by the lateral gates 37*a*, 37*b*. In this way, the full condition sensing section 37 is prevented from being stained by floating toner.

As waste toner flows into the waste toner box 30, the waste toner box 30 eventually becomes full of waste toner as indicated by dotted chain line β in FIG. 9. In this condition, the level of waste toner WT in the full condition sensing section 37 is slightly higher than that of waste toner WT in the waste toner box 30 and gets to the photodetector 38, by means of the supply of the auxiliary paddle 42. As the photodetector 38 detects that waste toner WT gets to it in the full condition sensing section 37 and the waste toner box 30 becomes full, the color copying machine 1 displays a message that the waste toner box 30 is full typically on a display panel (not shown) or the like.

When the photodetector 38 detects that the waste toner box 30 is full, the waste toner box 30 is actually filled with waste toner WT and the waste toner WT in the waste toner box 30 is leveled in the longitudinal direction to show a flat surface. Note, however, the level of the waste toner WT in the full condition sensing section 37 is slightly higher than that of waste toner WT in the waste toner box 30. In other words, when the photodetector 38 detects that the waste toner box 30 is full, there is still a small margin left in the waste toner box 30. As the message that the waste toner box 30 is full is displayed on the display panel, the operator takes out the full waste toner box 30 from the color copying machine 1 and mount a new and empty waste toner box 30 in the color copying machine 1 to replacement.

Thus, with this embodiment, the waste toner WT flowing into the waste toner box 30 by way of the first through fifth collection ports 31B, 31Y, 31M, 31C and 31K is leveled by the paddle 34 and supplied to the full condition sensing section 37 located above the shaft 34*a* of the paddle 34 by means of the auxiliary paddle 42 so as to pile up waste toner WT in the full condition sensing section 37. Thus, the photodetector 38 detects that the waste toner box 30 is full with a slight margin left in the waste toner box 30 as it actually detects the waste toner piled up slightly higher in the full condition sensing section 37.

With the above-described arrangement of the waste toner box 30, it is possible to eliminate a situation where waste toner exceeds the capacity upper limit at any of the first through fifth collection ports 31B, 31Y, 31M, 31C and 31K and is possible to eliminate a particular waste toner conveyance mechanism becomes locked. It is also possible to eliminate a situation where waste toner spills out from any of the first through fifth collection ports 31B, 31Y, 31M, 31C and 31K to contaminate the surroundings. In other words, it is possible to effectively use the waste toner box 30 and collect a large volume of waste toner in a safe manner.

The wall 40 is arranged between the full condition sensing section 37 and the adjacently located fifth collection port 31K. With this arrangement, it is possible to eliminate a situation where the full condition sensing section 37 is stained by the waste toner flying from the fifth collection port 31K that is located adjacent to the full condition sensing section 37 and floating in the waste toner box 30. Furthermore, the lateral gates 37*a*, 37*b* are arranged at the entrance of the full condition sensing section 37 to narrow the entrance of the full condition sensing section 37. Thus, it is possible to prevent floating toner from entering the full condition sensing section 37 to stain the latter. As a result, it is possible to eliminate a situation where flying toner and/or floating toner adheres the full condition sensing section 37 to make the photodetector 38 detect that the waste toner box 30 is full by error and hence improve the detecting accuracy.

Figure 10:
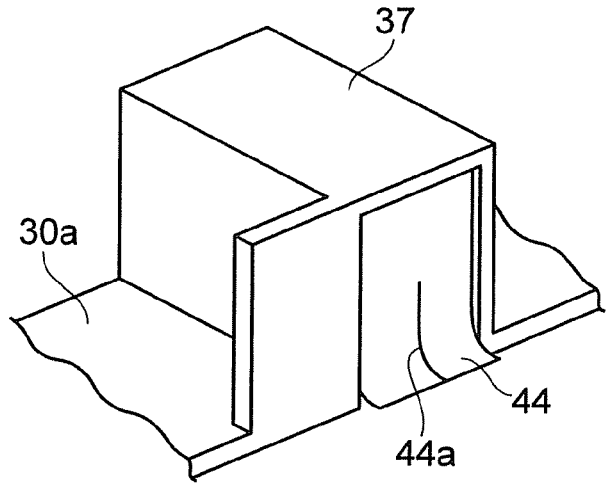
FIG. 10 is a schematic illustration of a projecting section of a first modification obtained by modifying the embodiment of the present invention.

The present invention is by no means limited to the above-described embodiment, which may be modified and altered in various different ways within the spirit and scope of the invention. For example, the profile and the material of the partition member for preventing flying toner and floating toner from adhering to the full condition sensing section may be appropriately defined. For instance, the lateral gates 37*a*, 37*b* of the above-described embodiment may be replaced by a thin sheet-like partition 44 as a shield member typically made of Mylar and arranged at the entire entrance of the full condition sensing section 37 shown in FIG. 10 as the first modification obtained by modifying the embodiment of the present invention. The partition 44 is provided with a slit 44*a* through which the waste toner supply member such as an auxiliary paddle can pass through. With this arrangement, it is possible to prevent flying toner and/or floating toner from entering the full condition sensing section 37 to adhere to the latter as in the case of the above-described embodiment. Then, it is possible to eliminate a situation where the photodetector 38 detects that the waste toner box 30 is full by error and hence improve the detecting accuracy.

Figure 11:
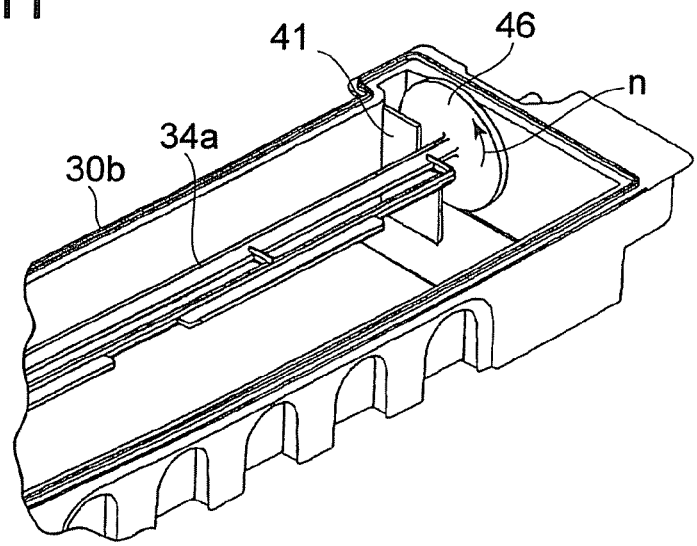
FIG. 11 is a schematic perspective view of part of a disk-shaped paddle of a second modification obtained by modifying the embodiment of the present invention.

The profile of the waste toner supply member may also be appropriately defined. For instance, a disk-shaped paddle 46 shown in FIG. 11 as the second modification obtained by modifying the embodiment of the present invention may be fitted to the shaft 34*a* of the above embodiment, so as to supply the full condition sensing section with waste toner. With this arrangement, it is possible to supply waste toner above the shaft 34*a* by means of the surfaces arranged parallel to the direction of rotation of the disk as indicated by arrow n in FIG. 11. A disk-shaped paddle 46 occur less floating toner if compared with the above-described fin-shaped auxiliary paddle that may occur floating toner as it moves in and out of the waste toner in the waste toner box through the surface thereof.

Figure 12:
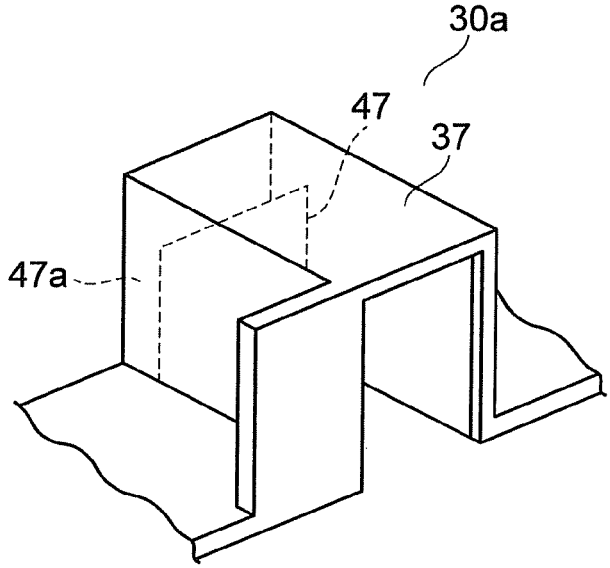
FIG. 12 is a schematic illustration of the projecting section of a third modification obtained by modifying the embodiment of the present invention.
Figure 13:
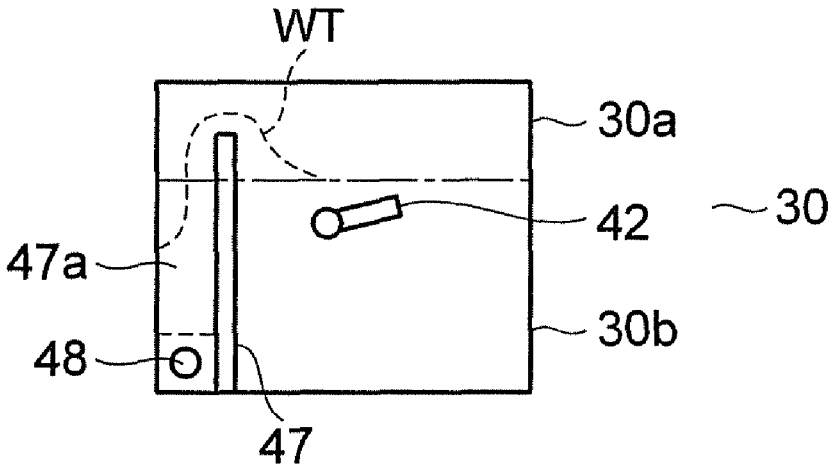
FIG. 13 is a schematic illustration of a waste toner accumulation area of the third modification obtained by modifying the embodiment of the present invention.

The profile of the full condition sensing section may also be appropriately be defined. For example, the full condition sensing section may be so designed as to guide the waste toner that is driven to move up by the drive shaft of the leveling member into a sensing area so as to be detected by a sensor. More specifically, a waste toner accumulation area 47*a* may be formed in the full condition sensing section 37 by using an auxiliary wall 47 that gets to the bottom surface of the main body section 30*b* of the embodiment of the present invention as shown in FIGS. 12 and 13 as the third modification obtained by modifying the above embodiment. Then, a photodetector 48 is arranged under the waste toner accumulation area 47*a*. As the waste toner box 30 becomes substantially full, the pile of the waste toner WT supplied to the full condition sensing section 37 by the auxiliary paddle 42 becomes higher than the auxiliary wall 47. The photodetector 48 detects the full condition of the waste toner box 30 by detecting the waste toner that passes above the auxiliary wall 47 and falls into the waste toner accumulation area 47*a*. With this arrangement, the photodetector 48 does not respond to a small amount of flying waste toner and/or floating waste toner and detects a full condition only when waste toner which overflows from the auxiliary wall 47 falls in the accumulation area 47*a*. Then, it is possible to reliably eliminate a situation where the photodetector 48 detect that the waste toner box 30 is full by error and hence improve the detecting accuracy.

For the purpose of the present invention, the full condition sensor may be a reflection type photodetector or a magnetic sensor that magnetically detects the volume of the waste toner that gets to the full condition sensing section. The profile and the structure of the waste toner containing member may be modified appropriately according to the configuration of the image forming apparatus main body. The number of collection ports is not limited to the above.

What is claimed is:

1. A waste toner collection apparatus comprising:

a waste toner containing member extending in the direction of arrangement of a plurality of image forming units respectively having toner image forming member arranged around image carriers so as to contain at least waste toner conveyed out from the plurality of image forming units;

a plurality of collection ports arranged at the waste toner containing member to collect the waste toner;

a leveling member configured to level the waste toner collected through the plurality of collection ports in the waste toner containing member;

a full condition sensing section formed at an upper part of the waste toner containing member to introduce the waste toner driven to get to an upper position by the drive shaft of the leveling member;

a partition member configured to separate the full condition sensing section and the collection port located adjacent to the full condition sensing section from each other;

a waste toner supply member configured to supply the waste toner to the full condition sensing section separated by the partition member; and a full condition sensor configured to sense the waste toner introduced to the full condition sensing section.

2. The waste toner collection apparatus according to claim 1, wherein the waste toner supply member piles up the waste toner of the waste toner containing member higher in the full condition sensing section.

3. The waste toner collection apparatus according to claim 1, wherein the leveling member is a paddle having a fin and adapted to be driven to rotate in the waste toner containing member and the waste toner supply member is an auxiliary paddle fitted to the drive shaft of the paddle.

4. The waste toner collection apparatus according to claim 3, wherein the full condition sensor is arranged above the drive shaft of the paddle and adapted to detect the waste toner introduced into the full condition sensing section.

5. The waste toner collection apparatus according to claim 1, wherein the full condition sensing section has an entrance configured to introduce the waste toner narrower than the sensing width of the full condition sensor.

6. The waste toner collection apparatus according to claim 1, wherein the full condition sensing section is arranged at a position corresponding to an end of arrangement of the image forming units.

7. The waste toner collection apparatus according to claim 1, wherein the full condition sensing section is provided at the entrance thereof with a shield member configured to prevent floating toner from entering.

8. The waste toner collection apparatus according to claim 1, wherein the waste toner containing member is adapted to additionally contain the waste toner produced from a transfer medium onto which the toner image formed on the image carrier is transferred.

9. An image forming apparatus comprising:

a plurality of image forming units respectively having toner image forming member for forming toner images on image carriers; and a waste toner collection apparatus including:

a waste toner containing member extending in the direction of arrangement of the plurality of image forming units so as to contain waste toner conveyed out from the plurality of image forming units;

a plurality of collection ports arranged at the waste toner containing member to collect the waste toner;

a leveling member configured to level the waste toner collected through the plurality of collection ports in the waste toner containing member;

a full condition sensing section formed at an upper part of the waste toner containing member to introduce the waste toner driven to get to an upper position by the drive shaft of the leveling member;

a partition member configured to separate the full condition sensing section and the collection port located adjacent to the full condition sensing section from each other;

a waste toner supply member configured to supply the waste toner to the full condition sensing section separated by the partition member; and a full condition sensor configured to sense the waste toner introduced to the full condition sensing section.

10. The image forming apparatus according to claim 9, wherein the waste toner supply member piles up the waste toner of the waste toner containing member higher in the full condition sensing section.

11. The image forming apparatus according to claim 9, wherein the leveling member is a paddle having a fin and adapted to be driven to rotate in the waste toner containing member and the waste toner supply member is an auxiliary paddle fitted to the drive shaft of the paddle.

12. The image forming apparatus according to claim 11, wherein the full condition sensor is arranged above the drive shaft of the paddle and adapted to detect the waste toner introduced into the full condition sensing section.

13. The image forming apparatus according to claim 9, wherein the full condition sensing section has an entrance configured to introduce the waste toner narrower than the sensing width of the full condition sensor.

14. The image forming apparatus according to claim 9, wherein the full condition sensing section is arranged at a position corresponding to an end of arrangement of the image forming units.

15. The image forming apparatus according to claim 9, wherein the full condition sensing section is provided at the entrance thereof with a shield member configured to prevent floating toner from entering.

16. The image forming apparatus according to claim 9, wherein the waste toner containing member is adapted to additionally contain the waste toner produced from a transfer medium onto which the toner image formed on the image carrier is transferred.

* * * * *